US007314381B2

(12) United States Patent
Suda

(10) Patent No.: US 7,314,381 B2
(45) Date of Patent: Jan. 1, 2008

(54) ELECTRIC COMPONENT HAVING CONNECTOR ATTACHED TO CASE VIA SEAL MEMBER

(75) Inventor: Kazuhiko Suda, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/358,307

(22) Filed: Feb. 21, 2006

(65) Prior Publication Data

US 2006/0216961 A1 Sep. 28, 2006

(30) Foreign Application Priority Data

Feb. 28, 2005 (JP) ..... 2005-053139

(51) Int. Cl.
*H01R 13/52* (2006.01)

(52) U.S. Cl. ..... 439/271

(58) Field of Classification Search ..... 439/271, 439/59, 367, 374, 379, 519
See application file for complete search history.

(56) References Cited

U.S. PATENT DOCUMENTS 4,804,115 A * 2/1989 Ball ..... 222/209
4,834,675 A * 5/1989 Samchisen ..... 439/578
5,662,494 A * 9/1997 Zennamo et al. ..... 439/589
6,323,743 B1 * 11/2001 Zelenz et al. ..... 333/185
6,354,852 B2 * 3/2002 Noro et al. ..... 439/157

FOREIGN PATENT DOCUMENTS

JP 10-172643 6/1998

* cited by examiner

*Primary Examiner*—Chandrika Prasad
(74) *Attorney, Agent, or Firm*—Brinks Hofer Gilson & Lione

(57) ABSTRACT

A connector includes a connector body and a case member that is fitted to the connector body by a seal member. The connector body includes a male terminal-receiving cylindrical portion in which one end of each of the male terminal extends and a joint-receiving cylindrical portion in which a joint between the other end of each of the male terminals and a printed circuit board are positioned. Since the joint-receiving cylindrical portion is provided, the seal member can be widely mounted on the outer periphery of the joint-receiving cylindrical portion.

5 Claims, 5 Drawing Sheets

ELECTRIC COMPONENT HAVING CONNECTOR ATTACHED TO CASE VIA SEAL MEMBER

BACKGROUND OF THE INVENTION

1. Field of the Invention

The present invention relates to a connector-attached electrical component, particularly to a male-type connector-attached electric component.

2. Description of the Related Art

In the related art, a connector-attached electric component that is exposed to the environment is configured to have a sealed printed circuit board. FIG. 5 shows the connector-attached electric component having this configuration. The connector-attached electric component shown in FIG. 5 is configured to mainly include a terminal unit 101 with a male terminal 100 formed by insert molding and a case member 103 that covers a printed circuit board 102 connected with the male terminal 100 of the terminal unit 101. The terminal unit 101 includes a fitting guard 104 that covers a periphery of the case member 103, and the fitting guard 104 and the periphery of the case member 103 are connected by snap-fitting. The male terminal 100 passes through holes formed in the printed circuit board 102 to be joined thereto by soldering. Further, the printed circuit board 102 is positioned by a guide 105 that is formed on the inside of the case member 103 to be held in the case member. An end face 103*a* of the case member 103 comes in contact with an end face 101*a* of the terminal unit 101 and a seal member 106 is interposed between the end faces 103*a* and 101*a*. The connector-attached electric component is disclosed in JP-A-10-172643 in detail.

In the connector-attached electric component configured as described above, however, the terminal unit 101 and the case member 103 are just in contact with each other by interposing the seal member 106 between the end faces 101*a* and 103*a*. In this case, a clearance is required between the fitting guard 104 of the terminal unit 101 and the periphery of the case member 103 in a direction (a direction indicated by an arrow in FIG. 5) in which they relatively slide. Accordingly, the clearance influences the sealing between the terminal unit 101 and the case member 103, such that it the quality of sealing in the case member 103 is deteriorated. It is required to enlarge the width D of an overlapping area between the terminal unit 101 and the inner periphery of the case member 103 in order to ensure the sealing between the terminal unit 101 and the case member 103. However, when the width D of the overlapping area is enlarged, a total length of the terminal unit 101 and the case member 103 increases, therefore, the electric component increases in size.

SUMMARY OF THE INVENTION

The present invention has been finalized in view of the above-mentioned problems and it is an object of the present invention to provide a connector-attached electric component that can be mounted with an electric component such as a printed circuit board in a sealed state and can be configured not to increase in a total length.

A connector-attached electric component according to an aspect of the present invention includes male terminals, a printed board, a connector body that has a male terminal-receiving cylindrical portion in which one end of the male terminals extend and a joint-receiving cylindrical portion in which a joint between the other end of the male terminals and a printed circuit board are positioned, a seal member that is disposed on the outside of the joint-receiving cylindrical portion of a terminal unit, and a case member that is mounted on the outside of the joint-receiving cylindrical portion, by the seal member.

According to the above configuration, the joint between the printed circuit board and the male terminals is positioned on the inside of the joint-receiving cylindrical portion of the connector body and the seal member that can maintain the sealed state between the connector body and the assembled case member is disposed on the outside of the joint-receiving cylindrical portion. By disposing in this way, the seal member can be mounted widely on the outside of the joint-receiving cylindrical portion. As a result, although a clearance is defined in the connection between the connector body and the case member, the sealing between the connector body and the case member can be performed using the seal member by applying a force from the outside of the connector body in a radial direction, therefore, the quality of the sealing can be sufficiently maintained and the printed circuit board can be protected from environmental circumstances. Further, the joint between the printed circuit board and the male terminals can be positioned in the joint-receiving cylindrical portion, thus a part of the printed circuit board can be disposed in the joint-receiving cylindrical portion. In this regard, a space in the joint-receiving cylindrical portion can be effectively used, thus the connector-attached electric component can decrease in total size.

In the connector-attached electric component according to the aspect of the invention, the connector body has a first fitting portion, the case member has a second fitting portion, and the connector body is preferably mounted in the case member by snap-in-fitting of the first and second fitting portion. By this configuration, the connector body can be reliably connected to the case member.

In the connector-attached electric component according to the aspect of the invention, a connector unit preferably includes a male terminal block to which a plurality of the terminals is fixed, a printed circuit board on which the male terminal block is mounted, and a connector body that has a wall having holes for inserting the male terminals thereinto and is connected with the male terminal block.

According to the above configuration, the male terminal block is separated from the connector body, therefore, the male terminals can be joined with the printed circuit board without being influenced by the shape of the connector body. In other words, since the printed circuit board is mounted on the male terminal block having a simple shape that the male terminals can pass therethrough, the male terminals can be simply joined with the printed circuit board only by using a joining means such as soldering.

In the connector-attached electric component according to the aspect of the invention, the joint-receiving cylindrical portion preferably has a first guide portion for guiding the printed circuit board therein. By the configuration, the printed circuit board can be positioned in the connector body.

In the connector-attached electric component of the invention, the joint-receiving cylindrical portion preferably has a second guide portion for guiding the male terminal block therein. With this configuration, the male terminal block can be positioned in the connector body.

In the connector-attached electric component of the invention, the connector body has a third fitting portion, the male terminal block has a fourth fitting portion, and the connector body is preferably connected with the male terminal block by snap-in-fitting of the third and fourth fitting portions. With this configuration, the male terminal block can be reliably connected to the connector body.

DESCRIPTION OF THE PREFERRED EMBODIMENT

Figure 1:
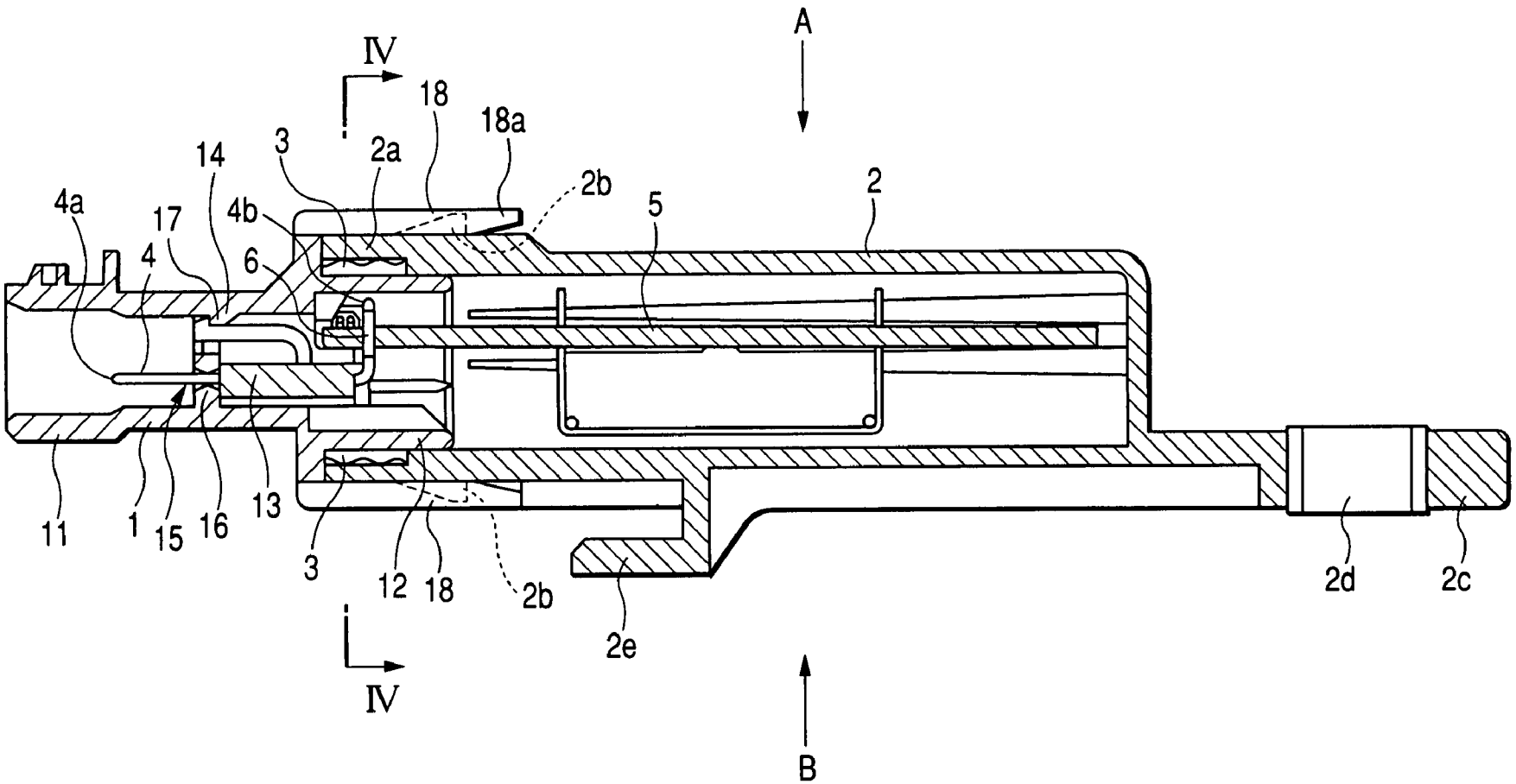
FIG. 1 is a cross-sectional view of a connector-attached electric component according to an embodiment of the present invention.

Preferred embodiments of the present invention will now be described with reference to the drawings. FIG. 1 is a cross-sectional view illustrating an embodiment of a connector according to the invention. In FIG. 1, a connector-attached electric component mainly includes a connector unit 1, a seal member 3 and a case member 2.

Figure 2A:
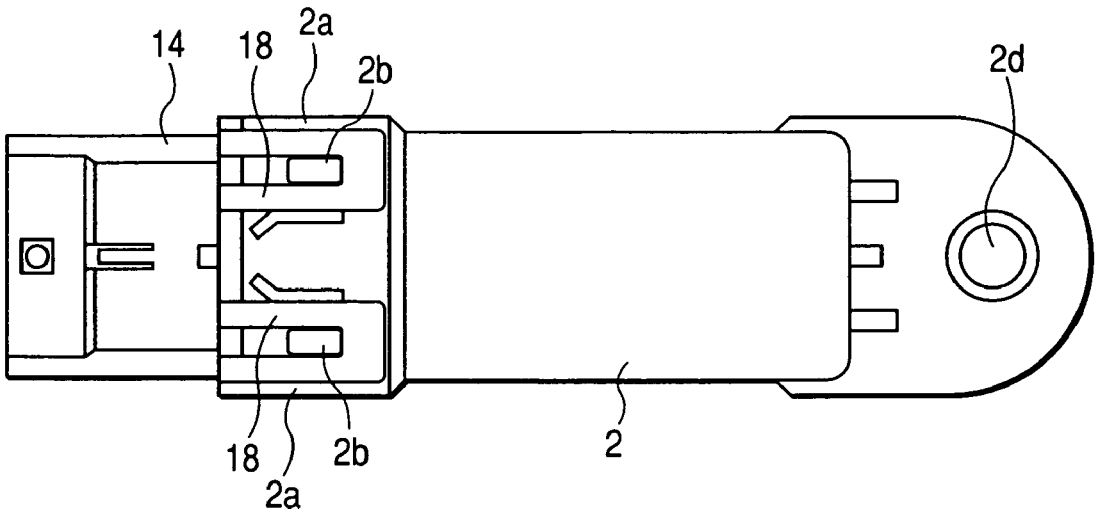
FIG. 2A is a plan view seen from 'A' in FIG. 1.
Figure 2B:
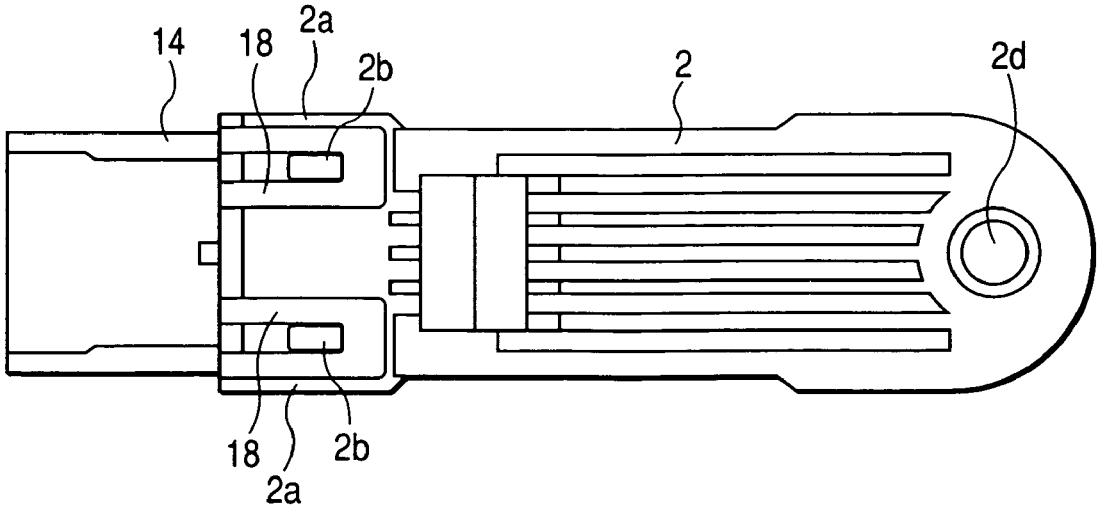
FIG. 2B is a plan view seen from 'B' in FIG. 1.

The connector unit 1 includes a male terminal block 13 on which a printed circuit board 5 is attached and a connector body 14 that is connected with the male terminal block 13. The connector body 14 includes a joint-receiving cylindrical portion 12, a male terminal-receiving portion 11 and a wall 16 having holes 15 through which the male terminals 4 can pass. Further, the connector body has a fitting guard 18 on the outside of the joint-receiving cylindrical portion 12 so that a periphery 2*a* of the case member 2 is inserted between the fitting guard 18 and the joint-receiving cylindrical portion 12. The fitting guard 18 is provided with a first fitting portion, that is, a snap-in-fitting portion 18*a*. The snap-in-fitting portion 18*a* is tapered to become thinner toward the front end of the fitting guard 18. Further, a second fitting portion, that is, a fitting projection 2*b* protruding outside is formed on the periphery of the case member 2. The fitting projection 2*b* is tapered to become higher toward a side of the case member 2 which is opposite to the connector body 4 (toward the right side in FIG. 1). As shown in FIG. 2A and 2B, by inserting the periphery 2*a* of the case member 2 between the fitting guard 18 and the joint-portion receiving cylindrical portion 12, the fitting projection 2*b* is snap-fitted into the snap-fitting portion 18*a* and then the connector body 4 and the case member 2 are connected to each other. In other words, the connector unit 1 and the case member 2 are connected. As described above, the connector body 14 (connector unit 1) and the case member 2 can be reliably connected by the snap-fitting of them. In this embodiment, even though the snap-in-fitting portion 18*a* is formed in the connector body 14 and the fitting projection 2*b* is formed in the case member 2, a snap-in-fitting portion may be formed in the case member 2 for the snap-fitting. FIGS. 2A and 2B are plan views seen from 'A' and 'B' in FIG. 1, respectively.

A seal member 3 is interposed between the outer periphery of the joint-receiving cylindrical portion 12 of the connector body 14 in the connector unit 1 and the inner periphery of the case member 12 while the connector unit 1 and the case member 2 are connected to each other as described above. In this case, the seal member 3 has two mount-shaped portions, but the number of mountain-shaped portions is not limited to a specific value. In general, when the number of mountain-shaped portions is large, and the width of the seal member 3 increase, the sealing quality can be improved. Further, an elastic material may be used as the seal member 3. The sealing between the connector unit 1 and the case member 3 is possibly carried out by the seal member 3. As a result, the printed circuit board 5 received in the case member 2 can be protected from environmental circumstances. Since there is the joint-receiving cylindrical portion 12, the seal member 3 can be widely provided throughout the outer periphery of the joint-receiving cylindrical portion 12. Further, the periphery 2*a* of the case member 2 is radially compressed, due to the snap-fitting to the fitting guard of the connector body, as described above. Therefore, by widely providing the seal member 3 in a slide direction of the case member 2 as described above, the radially compressed area becomes wide, such that the sealing can be effectively carried out and the printed circuit board 5 received in the case member 2 can be reliably protected from external circumstances. In addition, a guide 2*f*, which guides the printed circuit board 5 when connecting the case member 2 and the connector unit 1, is formed on the sidewall of the case member 2. The position of the printed circuit board 5 in the case member 2 should be determined in consideration of the above conditions.

Furthermore, a protrusion 2*e* is provided at the bottom of the case member 2. A connector-attached electric component can be connected to another member by hooking up the protrusion 2*e* to a concave portion or a groove of the member. In addition, a fastening portion 2*c* which extends to the opposite side to the connector unit 1 is provided on the bottom of the case member 2, and a hole 2*d* is formed in the fastening portion 2*c*. Therefore, it is possible to fix the connector-attached electric component to another member by screwing the fastening portion 2*c* through the hole 2*d* after hooking up the protrusion 2*e* to the concave portion or the groove of the member.

Figure 3A:
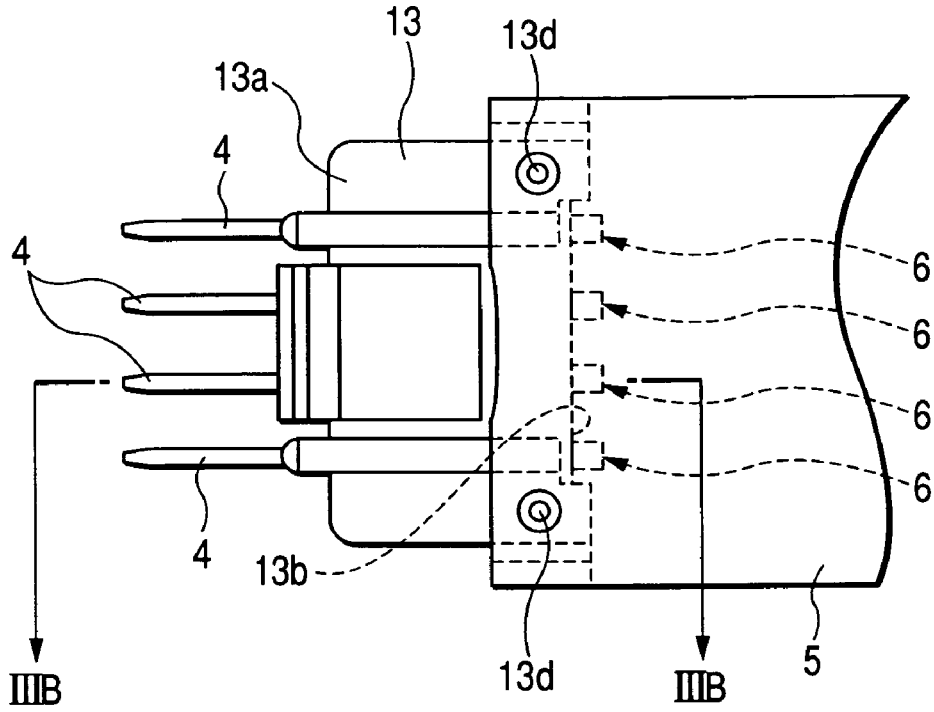
FIG. 3A is a plan view of a male terminal block of the connector-attached electric component according to an embodiment of the present invention.
Figure 3B:
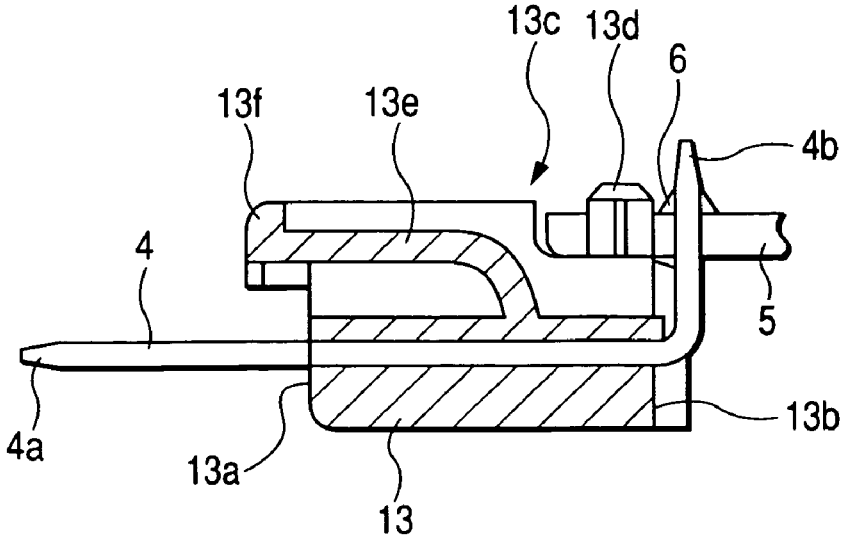
FIG. 3B is a cross-sectional view taken along the line IIIB-IIIB in FIG. 3A.

FIG. 3A is a plan view showing the male terminal block of the connector-attached electric component of the embodiment according to the present invention and FIG. 3B is a cross-sectional view taken along the line IIIB-IIIB in FIG. 3A. The male terminal block 13 is formed in a rectangular parallelepiped shape and each male terminal 4 extends from a pair of end faces 13*a* and 13*b* that face each other. In other words, ends 4*a* of the male terminals 4 extend from the end face 13*a* facing the connector body 14 and the other ends 4*b* extend from the end face 13*b* facing the case member 2. The ends 4*a* of the male terminal 4 are electrically connected to terminals of a female connector that is connected to the connector body. The other ends 4*b* of the male terminals 4 protrude from the male terminal block 13, bend at a right angle (upward in FIG. 3B) and pass through the printed circuit board 5. The ends 4*b* are then soldered to the printed circuit board 5.

A concave portion 13*c* that has a depth corresponding to a thickness of the printed circuit board 5 is formed on the upper surface of the male terminal block 13 to receive the printed circuit board 5. A plurality of positioning projections (two positioning projections in this case) are formed on the concave portion 13*c* to be fitted to holes formed in the printed circuit board 5. Therefore, by soldering the male terminal 4 to the printed circuit board 5 and fitting the projections 13*d* of the male terminal block 13 to the holes of the printed circuit board 5, the printed circuit board 5 is connected with the male terminal block 13.

Further, an elastic arm 13*e*, which protrudes upward from the body and extends to the end face 13*a*, is formed at the center portion of the upper surface of the male terminal block 13. At a front end of the elastic arm 13*e*, a fourth fitting portion, i.e., a fitting projection 13*f* is formed to projects upward. The fitting projection 13 is tapered to become thinner toward the front end. Meanwhile, a third fitting portion, i.e., a fitting projection 17 is formed on an upper portion of inner periphery near a wall 16 of the connector body 14. The fitting projection 17 is tapered to be thinner toward the joint-receiving cylindrical portion 12. By the snap-fitting of the fitting projection 13*f* of the male terminal block 13 and the fitting projection 17 of the connector body 14, the male terminal block 13 is connected to the connector body 14. In this state, the ends 4*a* of the terminals 4 passing through the male terminal block 13 are inserted into the holes 15 formed in the wall 16 of the connector body 14. In addition, the end face 13*a* of the male terminal block 13 comes in contact with the wall 16 of the connector body 14. By the snap-fitting of the fitting projections 13*f* and 17, and the contact of the end face 13*a* and the wall 16 as described above, the male terminal block 13 is positioned in the connector body 14 to be connected thereto.

The male terminals 4 and the printed circuit board 5 can be joined to each other regardless of the shape of the connector body 14, because the male terminal block 13 is separated from the connector body 14. In other words, the printed circuit board 5 is mounted on the male terminal block 13 that has a simple shape that the male terminals 4 can be inserted thereinto, therefore, the joining of the male terminal 4 and the circuit board 5 together can be simply carried out using a joining means such as a soldering.

Figure 4:
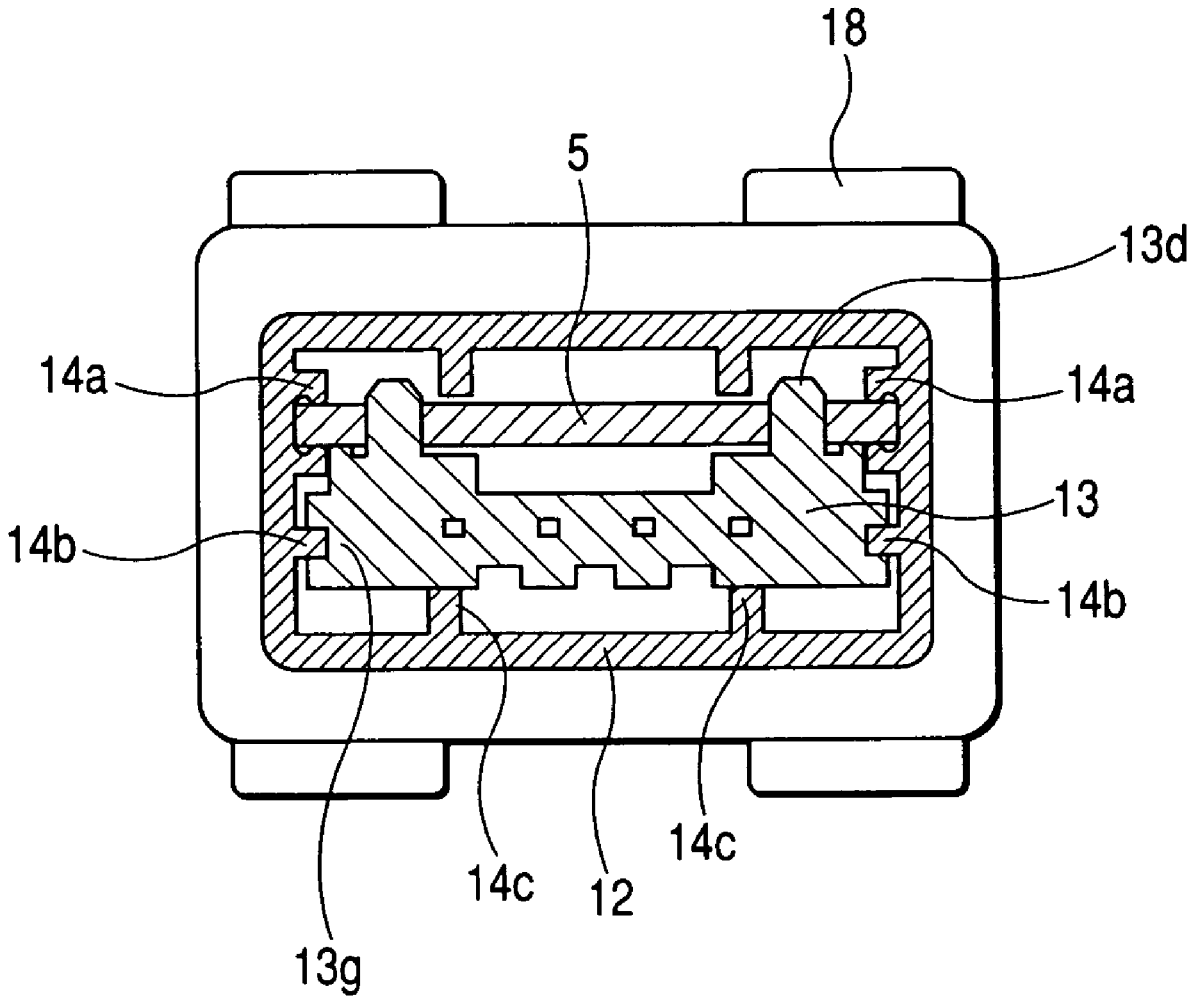
FIG. 4 is a cross-sectional view taken along the line IV-IV in FIG. 1.
Figure 5:
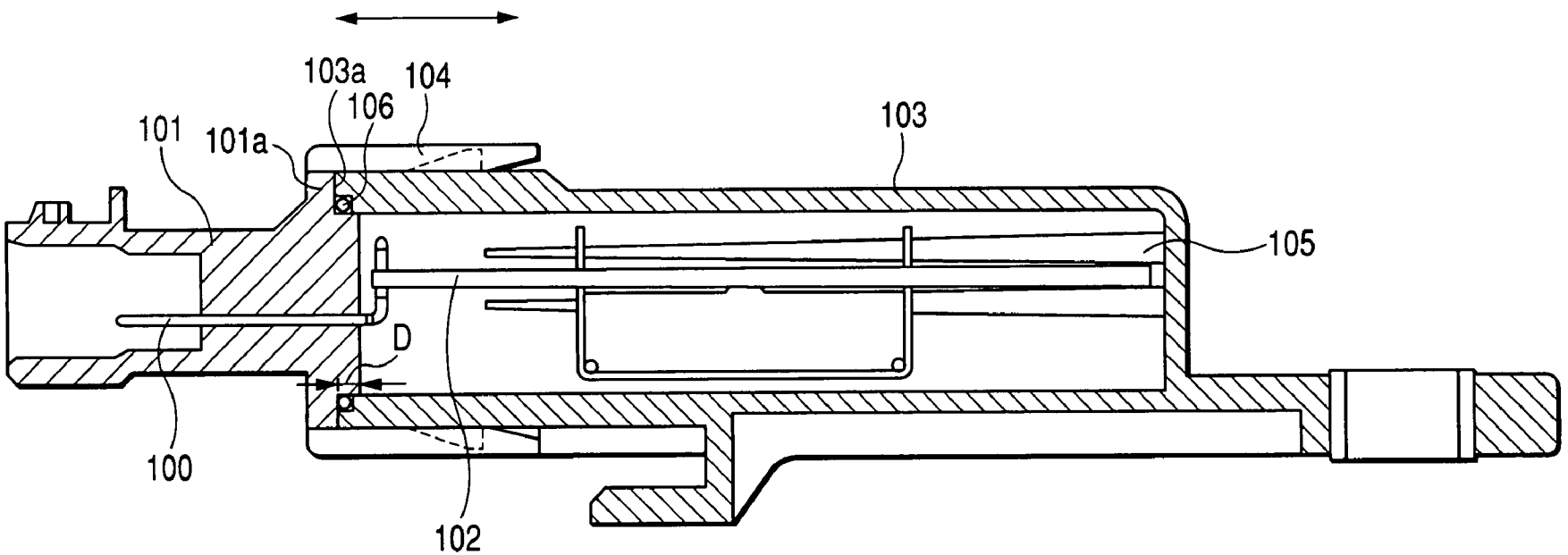
FIG. 5 PRIOR ART
FIG. 5 is a cross-sectional view of a connector-attached electric component in the related art.

FIG. 4 is a cross-sectional view taken along the line IV-IV in FIG. 1. Three pairs of protrusions are formed on the inside of the connector body 14 which face each other. A first guide portion, that is, a guide 14*a* for the printed circuit board 5 is defined by the upper protrusions and the middle protrusions, and the second guide portion, that is, a guide 14*b* for the male terminal block 13 is defined by the middle protrusions and the lower protrusions. Guide grooves 13*g* are formed on both sides of the male terminal block, respectively. When the male terminal block 13 with the printed circuit board 5 mounted therein is mounted into the connector body 14, the printed circuit board 5 is guided to the guide 14*a* and the male terminal block 13 is guided to the guide 14*b*. Accordingly, the printed circuit board 5 and the male terminal block can be positioned in the connector body 14. Further, protrusions 14*c* are also formed on the bottom of the connector body 14 and support the male terminal block 13. In this embodiment, even though three pairs of protrusions are formed on the inside of the connector body 14, and the middle protrusions serve as both the guide 14*a* for printed circuit board 14*a* and the guide 14*b* for the male terminal block 13, the guide 14*a* for the printed circuit board 5 and the guide 14*b* for the male terminal block 13 can be separately formed in the present invention. Moreover, in the above embodiment, the protrusions are formed on the inside of the connector body 14, the guide grooves 13*g* are formed on the sides of the male terminal block 13 so that the protrusions are engaged with the guide grooves 13*g*. However, it is further desirable to form the guide grooves on the inside of the connector body 14 and the protrusions on the sides of the male terminal block 13, so that the protrusions are engaged with the guide grooves in the present invention.

A connector-attached electric component configured as described above may be assembled as follows. Firstly, as shown in FIG. 3, the male terminal block 13 including male terminals formed by insert molding is provided. Next, a printed circuit board 5 on which electronic elements are mounted is mounted in the male terminal block 13. In other words, positioning projections 13*d* of the male terminal block 13 are fitted into corresponding holes of the printed circuit board 5 and ends 4*b* of male terminals 4 pass through the holes for the male terminal, which are also formed in the printed circuit board 5. In this state, the ends 4*b* of the male terminals 4 are soldered to conductive portions of the printed circuit board 5. As a result, the printed circuit board 5 is mounted in the male terminal block 13 and the male terminals are electrically connected with electric wirings on the printed circuit board 5.

As described above, by mounting the male terminal block 13, on which the printed circuit board 5 is mounted, into the connector body 14, a connector unit 1 is manufactured. In this case, ends 4*a* of the male terminals 4 mounted in the male terminal block 13 are inserted into a joint-receiving cylindrical portion 12 of the connector body 4, pass through holes 15 of the wall 16 and then extend to a male terminal-receiving cylindrical portion 11. The sides of the printed circuit board 5 are guided to the guide 14*a* for the printed circuit board of the connector body 14, and the guide 14*b* for the male terminal block of the connector body 14 is engaged with the guide grooves 13*g* formed on the side ends of the male terminal block 13. Therefore, it is possible to perform the positioning of the printed circuit board 5 and the male terminal block 13, and under this condition, the male terminal block 13 is mounted to the inside of the connector body 14. Further, when the male terminal block 13 is mounted into the connector body 14, the fitting projection 13*f* formed at the front end of the elastic arm 13*e* of the male terminal block 13 comes in contact with the fitting projection 17 of the connector body 14. In addition, if the male terminal block 13 is inserted into the connector body 14, a tapered face of the fitting projection 13*f* relatively moves along a tapered face of the fitting projection 17. When moving in this direction, the fitting projections 13*f* and 17 become gradually thicker along the moving direction, therefore, the elastic arm 13*e* elastically moves downward, that is, moves to the center of the connector body 14. When the fitting projection 13*f* and 17 slide over both thickest portions, they are engaged with each other. When the fitting projections 13*f* and 17 are snap-fitted in this manner, the end face 13*a* of the male terminal block 13 comes in contact with the wall 16. In this way, the male terminal block 13 is mounted in the connector body 14. The male terminals 4 are then arranged at positions where they can be connected with female terminals (not shown), in the male terminal-receiving cylindrical portion 11.

Next, a connector is manufactured by fitting the case member 2 to the connector unit 1 manufactured in the above-mentioned way. The side ends of printed circuit board 5 are guided to guide 2*f* for the printed circuit board, which is formed in the case member 2, so that the positioning of the printed circuit board 5 is carried out, and then the printed circuit board 5 is disposed into the case member 2 under this condition. Further, when the case member 2 is mounted to the connector unit 1, the snap-in-fitting portion 18*a* of the fitting guard 18 formed on the connector body 14 comes in contact with the fitting projection 2*b* of the case member 2. In addition, when the connector unit 1 is inserted into the case member 2, the tapered face of the snap-in-fitting portion 18*a* relatively moves along the tapered face of the fitting projection 2*b*. In such moving, the snap-in-fitting portion 18*a* and the fitting projection 2*b* become gradually thicker along the moving direction, which elastically broaden the fitting guard 18. When the snap-in-fitting portion 18*a* and the fitting projection slide over the thickest portions thoseof to be engaged with each other. In this case, since the seal member 3 is disposed on the outside of the joint-receiving cylindrical portion 12, the inner periphery of the case member 2 slides in the state of coming in contact with the mount-shaped portions of the seal member 3. The seal member 3 is pressed in a radial direction by the periphery of the case member 2. Accordingly, a sealing operation between the joint-receiving cylindrical portion 12 and the periphery of the case member 2 is carried out by the outward force by the elasticity of the seal member 3. As a result, the connector unit 1 is mounted in the case member 2. Therefore, a joint 6 between the printed circuit board 5 and the male terminals 4 is positioned in the joint-receiving cylindrical portion 12 of the connector body 14.

According to the connector of the above embodiment, the joint 6 between the printed circuit board 5 and the male terminal 4 is positioned in the joint-receiving cylindrical portion 12 of the connector body and the seal member 3, which can maintain the sealed state between the connector body 14 (connector unit 1) and the case member 2 to be assembled, is disposed on the outside of the joint-receiving cylindrical portion 12. By disposing in this way, it is possible to widely provide the seal member 3, which is disposed on the outside of the joint-receiving cylindrical portion 12, in the sliding direction of the peripheries of the fitting guard and the case member 2. As a result, although a clearance is defined in the connection between the connector body 14 and the case member 2, the sealing between the connector body 14 and the case member 2 can be performed using the seal member 3 by applying a force from the outside of the connector body 4 in a radial direction, therefore, the seal quality can be sufficiently maintained and the printed circuit board 5 can be protected from environmental circumstances. Further, since the joint 6 between the printed circuit board 5 and the male terminal 4 can be positioned in the joint-receiving cylindrical portion 12, a part of the printed circuit board 5 can be disposed in the joint-receiving cylindrical portion 12. Consequently, the space in the joint-receiving cylindrical portion 12 can be effectively used, thus the connector-attached electric component can decrease in total size.

According to the technical spirit of the present invention, it is preferable that the joint 6 between the printed circuit board 5 or another electric device and the male terminal 4 is positioned in the joint-receiving cylindrical portion 12 of the connector body 14 and the sealing member 3 may be disposed on the outside of the joint-receiving cylindrical portion 12, which can maintain the sealed state between the connector body and the case member 2 assembled. Another connector having the above-mentioned structure may be included.

The present invention is not limited to the above-mentioned embodiments and can be modified for a variety of embodiments. In the above embodiments, the soldering is described as a joint mechanism for the printed circuit board 5 and the male terminal 4, however, another joint mechanism other than the soldering may be used for joining the printed circuit board 5 or another electric device and the male terminal 4. In addition, it will be apparent to those skilled in the art that many additional and alternative embodiments are within the broad scope of this invention.

The connector-attached electric component includes male terminals, a printed board, a connector body that has a male terminal-receiving cylindrical portion in which one ends of the male terminal extend and a joint-receiving cylindrical portion in which a joint between the other ends of the male terminals and a printed circuit board is positioned, a seal member that is disposed on the outside of the joint-receiving cylindrical portion of a terminal unit, and a case member that is mounted on the outside of the joint-receiving cylindrical portion by the seal member, therefore, it is possible to provide a connector-attached electric component that can be mounted with an electric component such as a printed circuit board in a sealed state and is also configured not to increase in the total length.

The invention claimed is:

1. A connector-attached electric component, comprising: male terminals, a connector body that has a male terminal-receiving cylindrical portion in which one end of each of the male terminals extend and a joint-receiving cylindrical portion in which a joint between opposing ends of the male terminals and a printed circuit board are positioned, the connector body having a first fitting portion;

a seal member that is disposed on the outside of the joint-receiving cylindrical portion of a terminal unit-and a case member that is mounted on the outside of the joint-receiving cylindrical portion by the seal member, the case member having a second fitting portion, wherein the connector body is fitted to the case member by snap-in fitting of the first and second fitting portion, the seal member is interposed between the outer periphery of the joint-receiving cylindrical portion of the connector body and the inner periphery of the case member, and the joint-receiving cylindrical portion and the periphery of the case member are snap-fitted each other when the joint-receiving cylindrical portion is inserted into the periphery of the case member.

2. The connector-attached electric component according to claim 1, further comprising:

a connector unit including a male terminal block to which a plurality of the male terminals is fixed, the printed circuit board on which the male terminal block is mounted, and a portion of the connector body that has a wall having holes for inserting the male terminal therethrough and is connected with the male terminal block.

3. The connector-attached electric component according to claim 1, wherein the joint-receiving cylindrical portion includes a first guide portion that guides the printed circuit board therein.

4. The connector-attached electric component according to claim 2, wherein the joint-receiving cylindrical portion includes a second guide portion that guides the male terminal block therein.

5. The connector-attached electric component according to claim 2, wherein the connector body has a third fitting portion, the male terminal block has a fourth fitting portion, and the connector body is connected with the male terminal block by snap-in fitting of the third and fourth fitting portions.

* * * * *